US006389244B1

(12) United States Patent
Shima et al.

(10) Patent No.: US 6,389,244 B1
(45) Date of Patent: May 14, 2002

(54) TONER DENSITY SENSOR, AND INK JET HEAD, DEVELOPING UNIT AND IMAGE FORMING APPARATUS IN WHICH TONER DENSITY SENSOR IS USED

(75) Inventors: Kazuo Shima; Junichi Suetsugu; Toru Yakushiji, all of Kashiwazaki (JP)

(73) Assignee: NEC Corporation, Tokyo (JP)

( * ) Notice: Subject to any disclaimer, the term of this patent is extended or adjusted under 35 U.S.C. 154(b) by 25 days.

(21) Appl. No.: 09/229,305

(22) Filed: Jan. 13, 1999

(30) Foreign Application Priority Data

Jan. 13, 1998 (JP) ..... 10-004611

(51) Int. Cl.[7] ..... G03G 15/10
(52) U.S. Cl. ..... 399/58
(58) Field of Search ..... 399/57, 58, 64, 399/65

(56) References Cited

U.S. PATENT DOCUMENTS

| | | | | |
|---|---|---|---|---|
| 3,299,787 A | * | 1/1967 | Kolb et al. | 399/64 |
| 3,650,196 A | * | 3/1972 | Hosoe et al. | 399/64 X |
| 4,204,766 A | | 5/1980 | Harada | 356/404 |
| 4,671,309 A | * | 6/1987 | Iemura et al. | 399/57 |
| 5,319,421 A | | 6/1994 | West | 355/256 |
| 5,369,476 A | * | 11/1994 | Bowers et al. | 399/57 X |
| 5,724,629 A | * | 3/1998 | Iino et al. | 399/57 |

FOREIGN PATENT DOCUMENTS

| | | |
|---|---|---|
| EP | 0 171 902 | 2/1986 |
| EP | 0 589 653 | 3/1994 |
| JP | 41-21435 | 12/1941 |
| JP | 49-114430 | 10/1974 |
| JP | 50-106648 | 8/1975 |
| JP | 56-80473 | 7/1981 |
| JP | 58-111069 | 7/1983 |
| JP | 64-61253 | 3/1989 |
| JP | 4-278966 | 10/1992 |
| JP | 6-222680 | 8/1994 |
| JP | 8-285770 | 11/1996 |

* cited by examiner

*Primary Examiner*—Fred L. Braun
(74) *Attorney, Agent, or Firm*—Foley & Lardner

(57) ABSTRACT

A toner density sensor, including a light emitting element and a light receiving element, detects toner density even for a liquid developer having a low transmission factor. The toner density sensor includes a liquid developer tank for retaining liquid developer, a diluting liquid tank for retaining diluting liquid which is a base material of the liquid developer, and a mixing chamber connected to the tanks through two separate valve/pump assemblies which are opened and closed by a controller. A circulation passage is formed in the mixing chamber and has disposed therein a third pump and a transparent cell element. A quantity of light transmitted by the light emitting element and passing through liquid developer in the transparent cell element is measured by the light receiving element on an opposite side of the transparent cell element.

19 Claims, 5 Drawing Sheets

TONER DENSITY SENSOR, AND INK JET HEAD, DEVELOPING UNIT AND IMAGE FORMING APPARATUS IN WHICH TONER DENSITY SENSOR IS USED

BACKGROUND OF THE INVENTION

1. Field of the Invention

The present invention relates to a toner density sensor, and an ink jet head, a developing unit and an image forming apparatus in which a toner density sensor is used, and more particularly to a toner density sensor for a wet type image forming apparatus such as a printer, a facsimile or a copying machine, and an ink jet head, a developing unit and an image forming apparatus in which a toner density sensor is used.

2. Description of the Related Art

A wet type image forming apparatus uses liquid developer composed of toner dispersed in solution to develop an electrostatic latent image formed on a photosensitive member to form a visible toner image. In the wet type image forming apparatus, the toner density, that is, the ratio of the toner in the liquid developer, has a very serious influence on the image density, chapping, the resolution and so forth of the developed image. Meanwhile, since the toner in the liquid developer is gradually consumed as development is repeated, in order to always keep an appropriate toner density, the toner density is measured and, when the density drops, either warning information of this is developed or a suitable amount of toner or liquid developer of a high density is automatically supplemented.

Thus, a toner density sensor is required to measure the toner density in order to keep the toner density appropriate. One of such toner density sensors is disclosed in Japanese Patent Publication No. 21435/1966 wherein liquid developer is flowed in a passage formed from a transparent member and an amount of transmission light through the liquid developer is measured by means of a light emitting element and a light receiving element disposed in an opposing relationship to each other on the opposite sides of the passage and is utilized as a substitute characteristic of the toner density.

The toner density sensor, however, is disadvantageous in that toner density detection of an appropriate density is difficult. The reason is that, since liquid developer of an, appropriate density is very low in transmission factor, the transmission light through the liquid developer is attenuated by a large amount by the liquid developer. Further, if the light path length through the liquid developer is reduced in order to allow toner density detection of an appropriate density, then retention of the toner in the liquid developer or clogging of the passage with foreign articles in the light path becomes liable to occur and toner becomes liable to stick to the passage in the light path.

SUMMARY OF THE INVENTION

It is an object of the present invention to provide a toner density sensor by which, where light emitted from a light emitting element is passed through developing liquid and received by a light receiving element so that a density of the liquid developer may be detected from an output of the light receiving element, toner density detection of an appropriate density can be performed readily also with liquid developer whose transmission factor in a density upon measurement is very low.

In order to attain the object described above, according to an aspect of the present invention, there is provided a toner density sensor, comprising a light emitting element, a light receiving element for receiving light emitted from the light emitting element, a liquid developer tank for accommodating liquid developer therein, a diluting liquid tank for accommodating diluting liquid therein, a mixing chamber for mixing the liquid developer and the diluting liquid at a certain fixed ratio, a passage for forcedly circulating the diluted liquid developer, a transparent cell element disposed in the passage between the light emitting element and the light receiving element for allowing the light emitted from the light emitting element to be transmitted through the fluid passing the inside thereof so that an amount of the transmission light through the fluid may be measured by means of the light emitting element and the light receiving element, and means for detecting a density of the liquid developer based on the transmission light amount through the diluted liquid developer in the mixing chamber provided by an output of the light receiving element.

The toner density sensor is advantageous in that, even where the liquid developer has a very low transmission factor in a density upon measurement, toner density detection of an appropriate density can be performed readily. The reason is that, since the liquid developer is diluted normally at a certain fixed ratio, toner density detection within a density range within which the transmission light is attenuated but by a small amount can be performed even with a light path length, within which retention of toner or clogging with foreign articles in the liquid developer does not occur in the light path.

Preferably, the diluting liquid is a solution the same as a base material of the liquid developer.

Preferably, the light emitting element and the light receiving element are covered completely with a transparent member having a low surface energy property and are disposed in an opposing relationship to each other with a certain fixed gap left therebetween in the mixing chamber.

According to another aspect of the present invention, there is provided an ink jet head, comprising any of the toner density sensors described above.

According to a further aspect of the present invention, there is provided an image forming apparatus, comprising the ink jet head described above.

According to a still further aspect of the present invention, there is provided a developing unit, comprising means for making the density of the liquid developer fixed based on the density of the liquid developer detected by any of the toner density sensors described above According to a yet further aspect of the present invention, there is provided an electrophotographic image forming apparatus, comprising charging, exposure, transfer and fixing means, and the developing unit described above.

The above and other objects, features and advantages of the present invention will become apparent from the following description and the appended claims, taken in conjunction with the accompanying drawings in which like parts or elements are denoted by like reference symbols.

DESCRIPTION OF THE PREFERRED EMBODIMENTS

Figure 1:
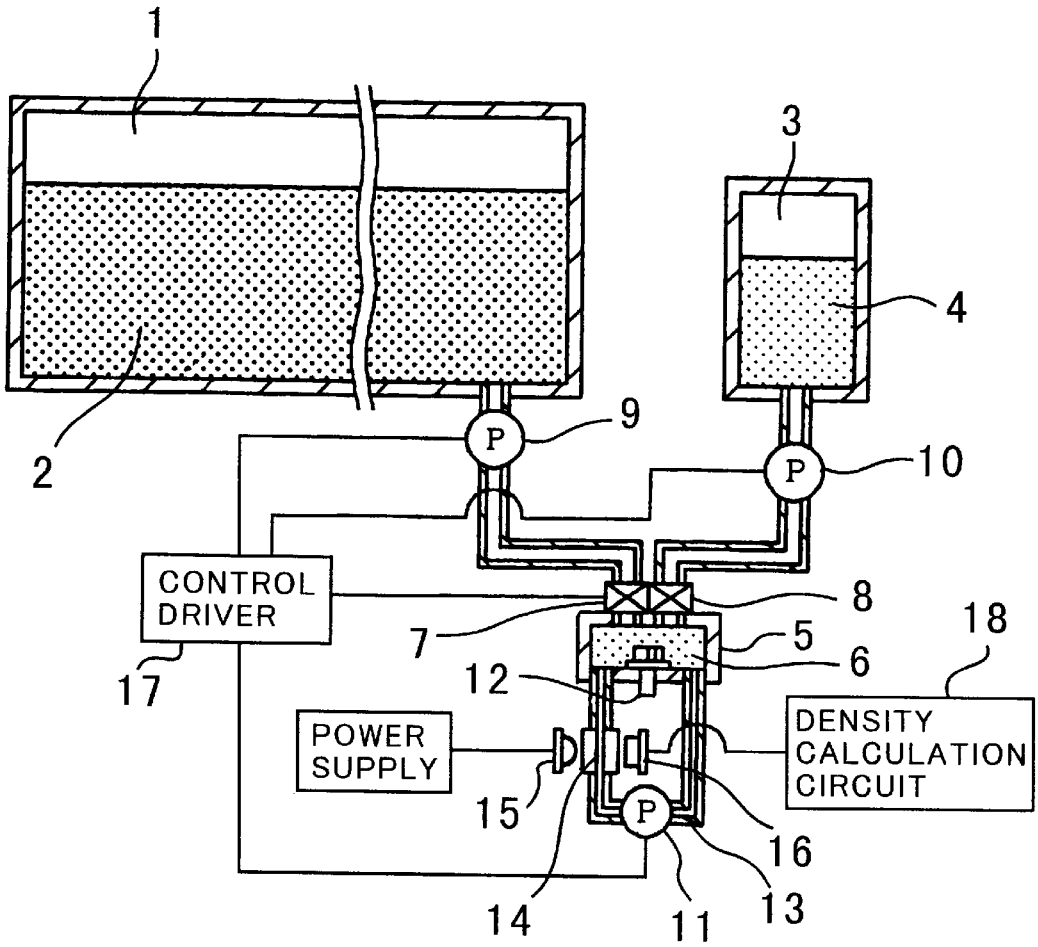
FIG. 1 is a schematic diagrammatic view of a toner density sensor to which the present invention is applied.

Referring first to FIG. 1, there is shown a toner density sensor to which the present invention is applied. The toner density sensor shown is incorporated in an ink jet head not shown of an image forming apparatus not shown such as, for example, a printer, a facsimile or a copying machine and includes a liquid developer tank 1 for accommodating liquid developer 2 to be used for development, a diluting liquid tank 3 for accommodating diluting liquid 4 formed of a base material of the liquid developer 2, and a mixing chamber 5 disposed outside and connected to the tanks 1 and 3 through a first valve 7 and a first pump 9, and a second valve 8 and a second pump 10, respectively. The first valve 7, second valve 8, first pump 9 and second pump 10 are controlled so as to be opened or closed by a control driver 17. A passage 13 of a circulation type is formed in part of the mixing chamber 5 with a third pump 11 interposed therein, and a transparent cell element 14 which allows an amount of transmission light through fluid which passes through the inside thereof to be measured is disposed in the passage 13. Further, a light emitting element 15 and a light receiving element 16 are disposed such that the transparent cell element 14 is positioned between them.

Operation of the toner density sensor is described below with reference to FIGS. 1 and 2(*a*) to 2(*c*).

Figure 2A:
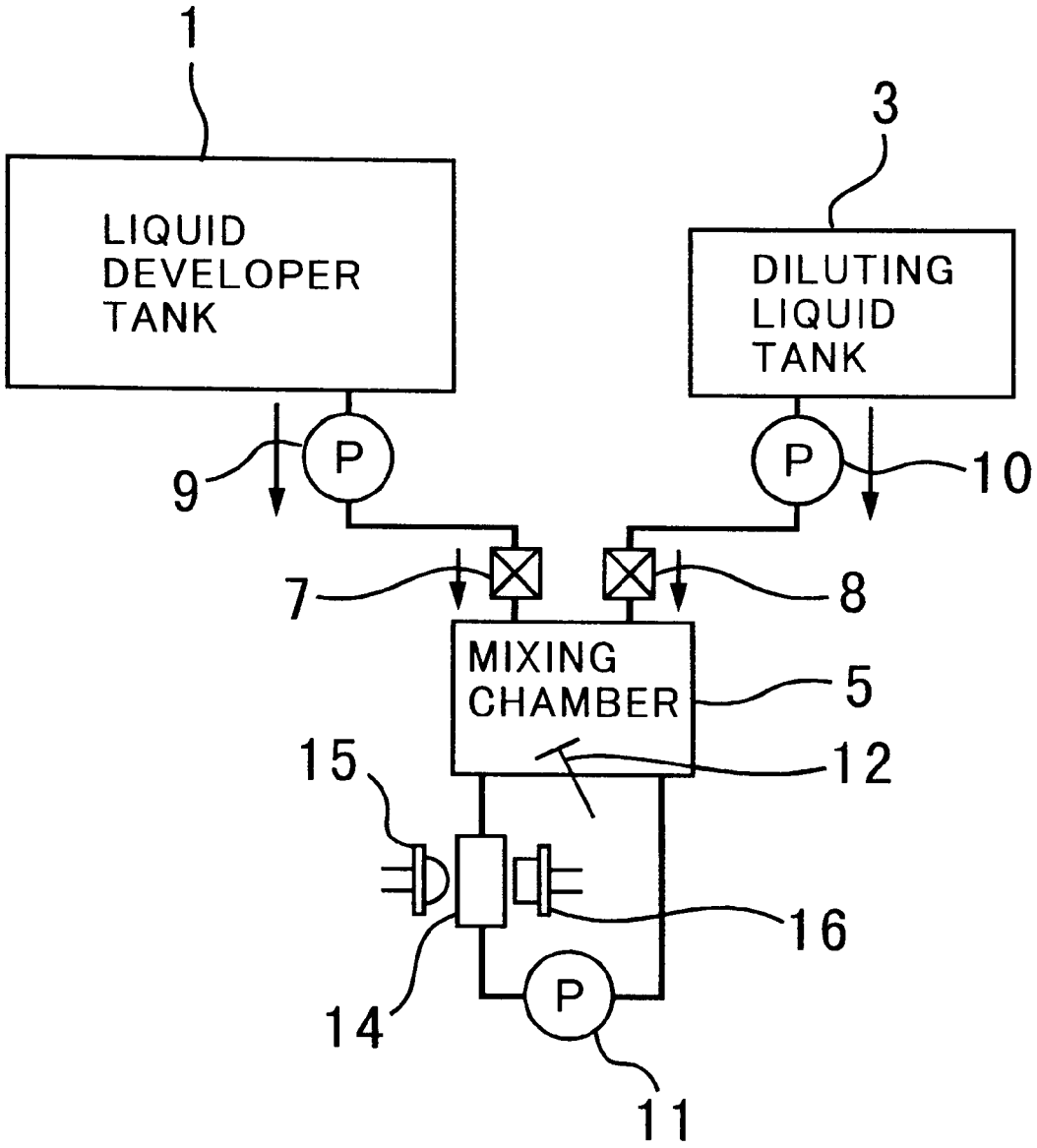
FIGS. 2(*a*) to 2(*c*) are schematic diagrammatic views illustrating operation of the toner density sensor of FIG. 1.
Figure 2B:
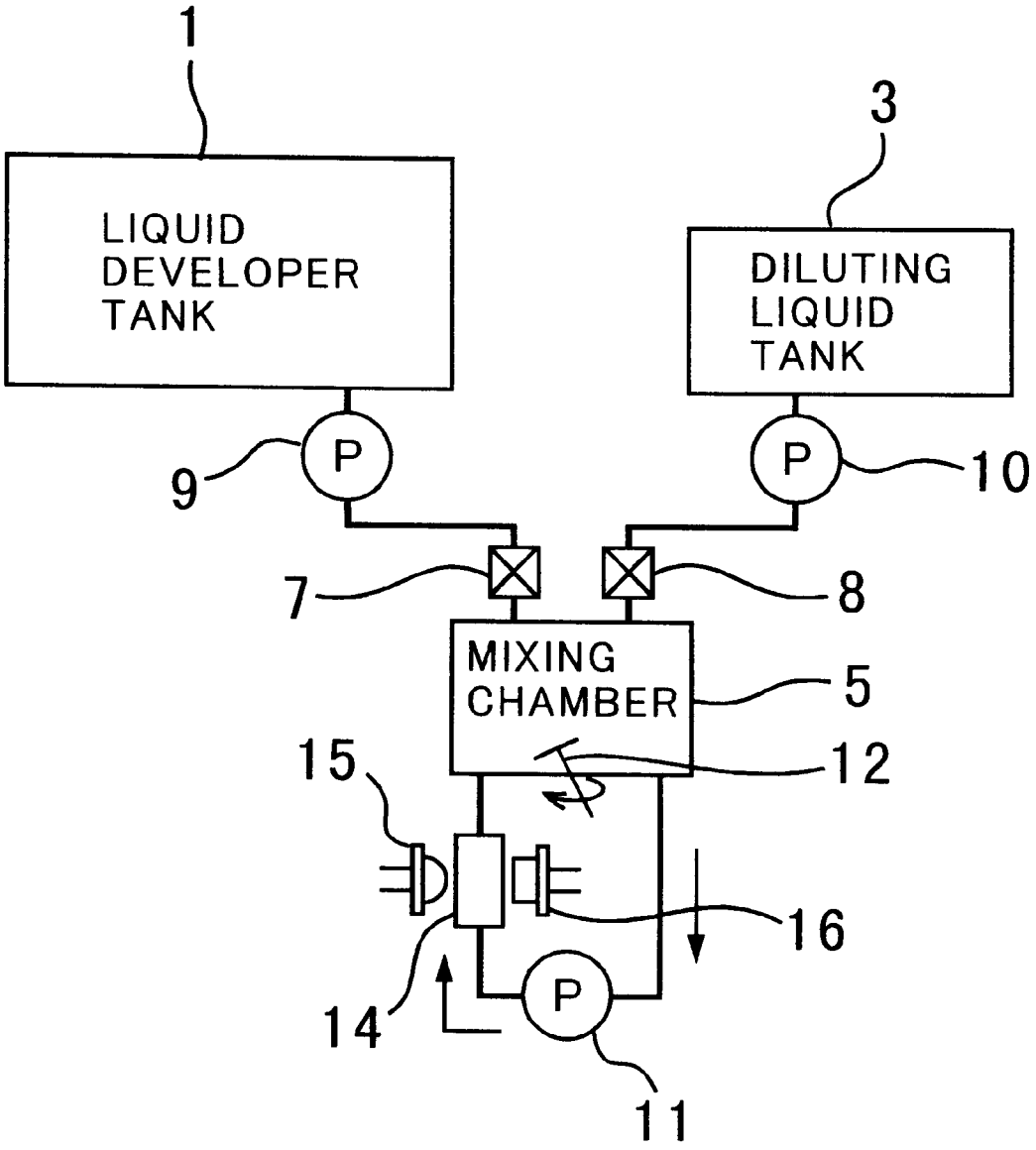
Figure 2C:
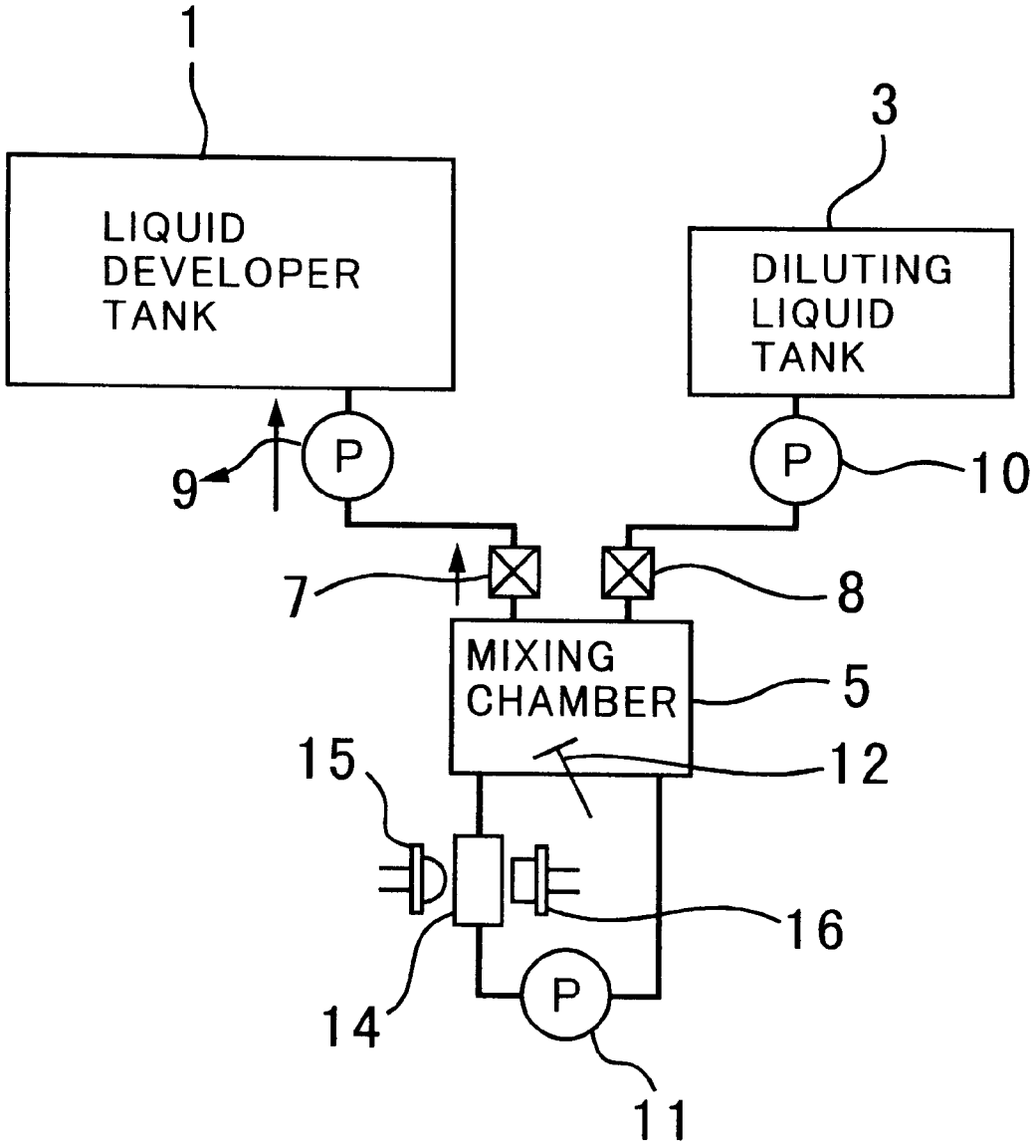

When the toner density is to be detected, the first valve 7 on the liquid developer tank 1 side is opened by the control driver 17 as seen in FIG. 2(*a*), and a predetermined amount of the liquid developer 2 leaves the liquid developer tank I and enters the mixing chamber 5. Simultaneously, the second valve 8 on the diluting liquid tank 3 side is opened by the control driver 17, and an amount of the diluting liquid 4 leaves the diluting liquid tank 3 and enters the mixing chamber 5. The amount of diluting liquid 4 supplied is determined by a fixed dilution ratio of the diluting liquid 4 to the liquid developer 2. After the predetermined amounts of the liquid developer 2 and the diluting liquid 4 are supplied into the mixing chamber 5, the first valve 7 and the second valve 8 are closed by the control driver 17 as seen from FIG. 2(*b*).

The liquid developer 2 and diluting liquid 4 supplied in the mixing chamber 5 are agitated by an agitation member 12 disposed in the mixing chamber 5 to make liquid developer 6 for toner density detection. The liquid developer 6 for toner density detection, when agitated sufficiently, is forcedly circulated between the mixing chamber 5 and the transparent cell element 14 by a third pump 11. Simultaneously, an amount of transmission light is passed through the liquid developer 6 for toner density detection in the transparent cell element 14. The toner density of the liquid developer 6 is measured by means of the light emitting element 15 and the light receiving element 16. A density calculation circuit 18 determines whether the liquid developer 2 in the liquid developer tank 1 has a density within an appropriate density range.

After the detection of the ink density is completed, the first valve 7 on the liquid developer tank 1 side is opened by the control driver as seen in FIG. 2(*c*), and the liquid developer 6 for toner density detection in the mixing chamber 5, in the transparent cell element 14 in the passage 13, is discharged into the liquid developer tank 1.

The present invention permits the toner density of the developer 2 to be measured even in cases where the liquid developer 2 has such a high density that the transmission light is attenuated by a great amount. Normally, in these situations the transmitted light cannot be measured unless the light path length of the transparent cell element 14 is made considerably small. However, the present invention provides for mixing, at a certain fixed ratio, the diluting liquid 4 with the liquid developer 2 in the mixing chamber 5. As a result, the light path length of the transparent cell element 14 is long enough that retention of toner or clogging of foreign articles does not occur. Liquid developer 6 for toner density detection is produced in the mixing chamber 5. The developer 6 is diluted to a density within a density range within which the amount of light transmitted can be. measured. The amount of light transmitted through the liquid developer 6 for toner density detection is measured at the transparent cell element 14. Then, the transmission light amount thus measured is compared with predetermined sample data of the density of the liquid developer 6 for toner density detection. The predetermined sample data has a lower limit value and an upper limit value thereby defining an appropriate density range; the density calculation circuit 18 determines whether the density of the liquid developer 2 falls within this range.

It is to be noted that, in order to prevent a great density variation from occurring between the liquid developer 2 and the liquid developer 6 for toner density detection (which is discharged into the liquid developer tank 1), preferably the amount of the liquid developer 6 for toner density detection is considerably smaller than the amount of the liquid developer 2.

Further, in order to prevent fixation of remaining toner when the inner face side of the transparent cell element 14 becomes dry after the liquid developer 6 for toner density detection is discharged, preferably the mixing chamber 5 and the transparent cell element 14 are always filled with the diluting liquid 4.

Figure 3:
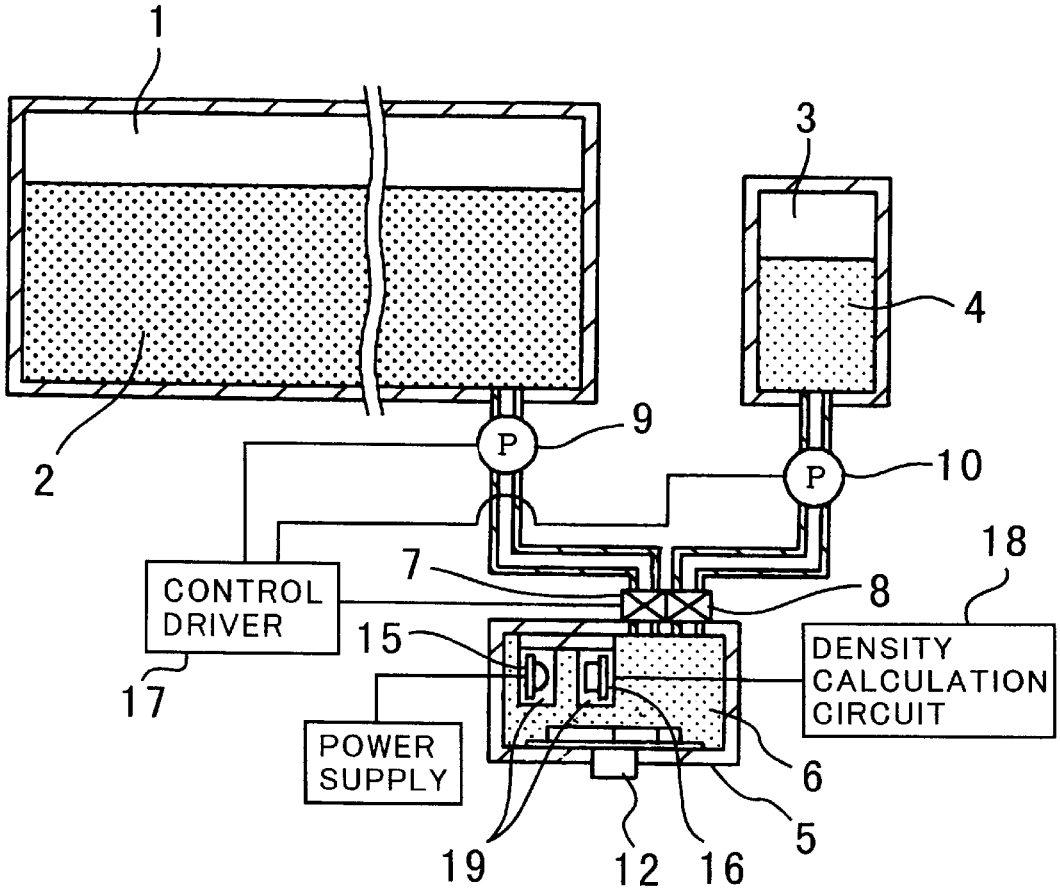
FIG. 3 is a schematic diagrammatic view of another toner density sensor to which the present invention is applied.

Referring to FIG. 3, there is shown another toner density sensor to which the present invention is applied. The toner density sensor of FIG. 3 is a modification to and different from the toner density sensor described hereinabove with reference to FIG. 1 in that the light emitting element 15 and the light receiving element 16 are covered completely with a transparent member 19 having a low surface energy property and disposed in an opposing relationship to each other with a certain fixed gap left therebetween in the mixing chamber 5.

When toner density detection is to be performed, the light emitting element 15 and the transparent cell element 14 are immersed in the liquid developer 6 for toner density detection in the mixing chamber 5, and the liquid developer 6 for toner density detection is agitated by the agitation member 12 in the mixing chamber 5. In this condition, the amount of light transmitted through the liquid developer 6 for toner density detection in the mixing chamber 5 is measured by the light emitting element 15 and the light receiving element 16. The density calculation circuit 18 determines, based on the amount of light transmitted, whether the liquid developer 2 in the liquid developer tank 1 has a density within an appropriate range.

While, in the foregoing description, the toner density sensor is incorporated in an ink jet head of an image forming apparatus such as, for example, a printer, a facsimile or a copying machine, it may otherwise be incorporated in a developer of an electrophotographic image forming apparatus which additionally includes charging, exposure, transferring and fixing means. Where the toner density sensor is incorporated in a developer, the density of the liquid developer is controlled based on a result of detection by the toner density sensor.

While preferred embodiments of the present invention have been described using specific terms, such description is for illustrative purpose only, and it is to be understood that changes and variations may be made without departing from the spirit or scope of the following claims.

What is claimed is:

1. A toner density sensor, comprising:

a light emitting element;

a light receiving element for receiving light emitted from said light emitting element;

a liquid developer tank for accommodating a liquid developer therein;

a diluting liquid tank for accommodating a diluting liquid therein;

a mixing chamber for mixing the liquid developer and the diluting liquid at a certain fixed ratio to create a diluted liquid developer;

a passage for forcedly circulating the diluted liquid developer;

a transparent cell element disposed in said passage between said light emitting element and said light receiving element for allowing the light emitted from said light emitting element to be transmitted through the diluted liquid developer in said passage so that an amount of the light transmitted through the diluted liquid developer may be measured by means of said light emitting element and said light receiving element; and means for detecting a density of the liquid developer based on the amount of the light transmitted through the diluted liquid developer in said passage which is represented by an output of said light receiving element.

2. A toner density sensor as claimed in claim 1, wherein the diluting liquid is a solution comprised substantially of a base material in the liquid developer.

3. A toner density sensor as claimed in claim 1, wherein said light emitting element and said light receiving element are covered completely with a transparent member having a low surface energy property and are disposed in an opposing relationship to each other with a certain fixed gap left; therebetween in said mixing chamber.

4. An ink jet head, comprising a toner density sensor as set forth in claim 1.

5. An ink jet head, comprising a toner density sensor as set forth in claim 2.

6. An ink jet head, comprising a toner density sensor as set forth in claim 3.

7. An image forming apparatus, comprising an ink jet head as set forth in claim 4.

8. An image forming apparatus, comprising an ink jet head as set forth in claim 5.

9. An image forming apparatus, comprising an ink jet head as set forth in claim 6.

10. A developing unit, comprising means for making the density of the liquid developer fixed based on the density of the liquid developer detected by a toner density sensor as set forth in claim 1.

11. A developing unit, comprising means for making the density of the liquid developer fixed based on the density of the liquid developer detected by a toner density sensor as set forth in claim 2.

12. A developing unit, comprising means for making the density of the liquid developer fixed based on the density of the liquid developer detected by a toner density sensor as set forth in claim 3.

13. An electrophotographic image forming apparatus, comprising charging, exposure, transfer and fixing means, and a developing unit as set forth in claim 10.

14. An electrophotographic image forming apparatus, comprising charging, exposure, transfer and fixing means, and a developing unit as set forth in claim 11.

15. An electrophotographic image forming apparatus, comprising charging, exposure, transfer and fixing means, and a developing unit as set forth in claim 12.

16. The toner density sensor as claimed in claim 1, further comprising:

an agitation element in the mixing chamber for mixing the diluting liquid and the liquid developer.

17. A method of determining toner density in a liquid developer comprising the steps of:

adding liquid developer to a mixing chamber;

adding a predetermined amount of diluting liquid to the mixing chamber;

mixing the liquid developer and the diluting liquid in a fixed ratio in the mixing chamber to create a diluted liquid developer;

forcedly circulating the diluted liquid developer through a transparent cell element in a passage;

transmitting light through the transparent cell element disposed in said passage;

receiving an amount of the light transmitted through the diluted liquid developer in the transparent cell element;

calculating the density of the liquid developer based on the amount of light transmitted.

18. The method of determining toner density in a liquid developer according to claim 17, further comprising the step of agitating the diluted liquid developer in the mixing chamber.

19. The method of determining toner density in a liquid developer according to claim 17, wherein the step of calculating the density of the liquid developer based on the amount of light transmitted comprises the step of comparing the amount of light received to a predetermined range of values corresponding to a density range.

* * * * *